United States Patent [19]

Jones

[11] Patent Number: 4,466,418

[45] Date of Patent: Aug. 21, 1984

[54] BOWSTRING TRIGGER RELEASE MECHANISM

[76] Inventor: Bobby L. Jones, 432 Adams St., Elyria, Ohio 44035

[21] Appl. No.: 401,561

[22] Filed: Jul. 26, 1982

[51] Int. Cl.[3] ..... F41B 5/00

[52] U.S. Cl. ..... 124/35 A; 124/23 R

[58] Field of Search ..... 124/35 A, 41 A, 24 R, 124/23 R, DIG. 1, 89, 88, 40

[56] References Cited

U.S. PATENT DOCUMENTS

| | | | |
|---|---|---|---|
| 2,417,791 | 3/1947 | Tyszkiewicz | 124/35 A |
| 2,815,016 | 12/1957 | Kellogg | 124/35 |
| 2,926,650 | 3/1960 | Irwin | 124/24 |
| 2,982,279 | 5/1961 | Pursley | 124/35 |
| 3,446,200 | 5/1969 | Gross | 124/24 R |
| 3,524,441 | 8/1970 | Jeffery | 124/89 X |
| 3,557,769 | 1/1971 | Hofmeister | 124/24 |
| 3,895,621 | 7/1975 | Kellogg | 124/24 |
| 4,030,473 | 6/1977 | Puryear | 124/35 |
| 4,192,281 | 3/1980 | King | 124/25 |
| 4,300,521 | 11/1981 | Schmitt | 124/DIG. 1 |

*Primary Examiner*—Richard J. Apley
*Assistant Examiner*—William R. Browne
*Attorney, Agent, or Firm*—Richard P. Matthews

[57] ABSTRACT

An archery bow is provided with a reverse stabilizer bar and a combined trigger and safety release mechanism. The reverse stabilizer bar tapers inwardly as it extends rearwardly from the bow and is made of a solid cross section so as to be capable of absorbing the shock of the bow when an arrow is released. An extension member is telescopically received within the rear of the stabilizer bar to provide variable length draw string positions. This telescoping extension member is provided with an offset end to mount a handle for receiving the combined trigger and safety release mechanism. The latter includes a cylindrical actuator spool which supports a rotatable arrow release member. The safety release mechanism is axially slidable on the actuator spool. Vertical movement of the safety release permits a trigger to be squeezed to shoot an arrow as the arrow release member rotates.

9 Claims, 6 Drawing Figures

BOWSTRING TRIGGER RELEASE MECHANISM

This invention relates to an attachment for an archery bow and, more particularly, to an attachment which will absorb the full recoil shock of the bow and permit an arrow to be fired by squeezing a trigger upon releasing a safety mechanism.

Heretofore it has been known to use a trigger mechanism to release an arrow from a bow after the arrow has been loaded. The devices have not been able to absorb the recoil shock of the bow making it difficult for people with medical problems such as heart trouble, shoulder or back problems to use these devices.

In accordance with the present invention, a reverse stabilizer bar is provided which absorbs the full recoil shock of the bow upon release of an arrow. In order to effect this, the stabilizer bar is made preferably from aluminum of solid cross section and it tapers inwardly as it extends rearwardly from the bow.

In addition, a combined trigger and safety release mechanism is provided for the archery bow. The trigger comprises a handle member which encapsulates a cylindrical actuator spool having a shaft-like extension on its upper end. A rotatable arrow release member is mounted on the shaft-like extension and it receives an arrow in its loaded position. A trigger mechanism carries one locking device which is received in a slot of the rotatable release member to lock it in its loaded position.

The trigger mechanism also carries another locking device in the form of a slot which receives the bottom edge of a cylindrically-shaped safety member to prevent the arrow from being shot prematurely. This safety member moves axially along the cylindrical actuator spool controlled by the thumb of the user.

Not only is the archery bow as modified in accordance with the present invention suitable for use by persons with medical problems as described previously, it is also well suited for women who enjoy hunting big game animals with bow and arrow.

These and other features of the present invention will become more readily apparent upon reference to the following detailed description of the invention and by reference to the drawings wherein.

DETAILED DESCRIPTION OF THE INVENTION

Figure 1:
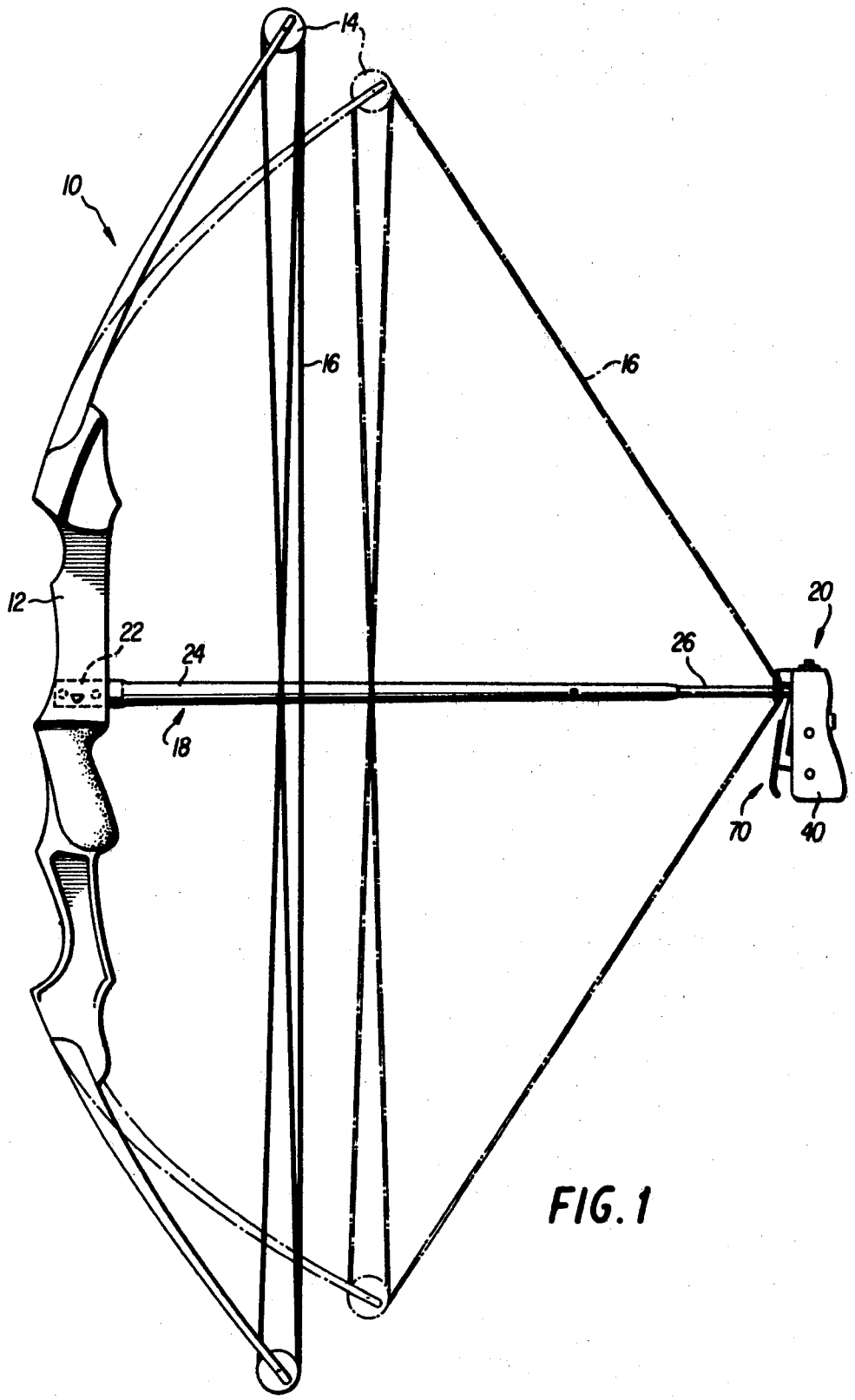
FIG. 1 is a side elevational view showing a compound bow modified in accordance with the present invention.

Referring now to FIG. 1 of the drawings, there is illustrated an archery bow and attachments thereto indicated generally at 10 consisting of a bow 12 having pulleys 14 and a bow string 16. A reverse stabilizer bar means is indicated generally at 18 and a combined trigger and safety release mechanism is indicated generally at 20.

Figure 2:
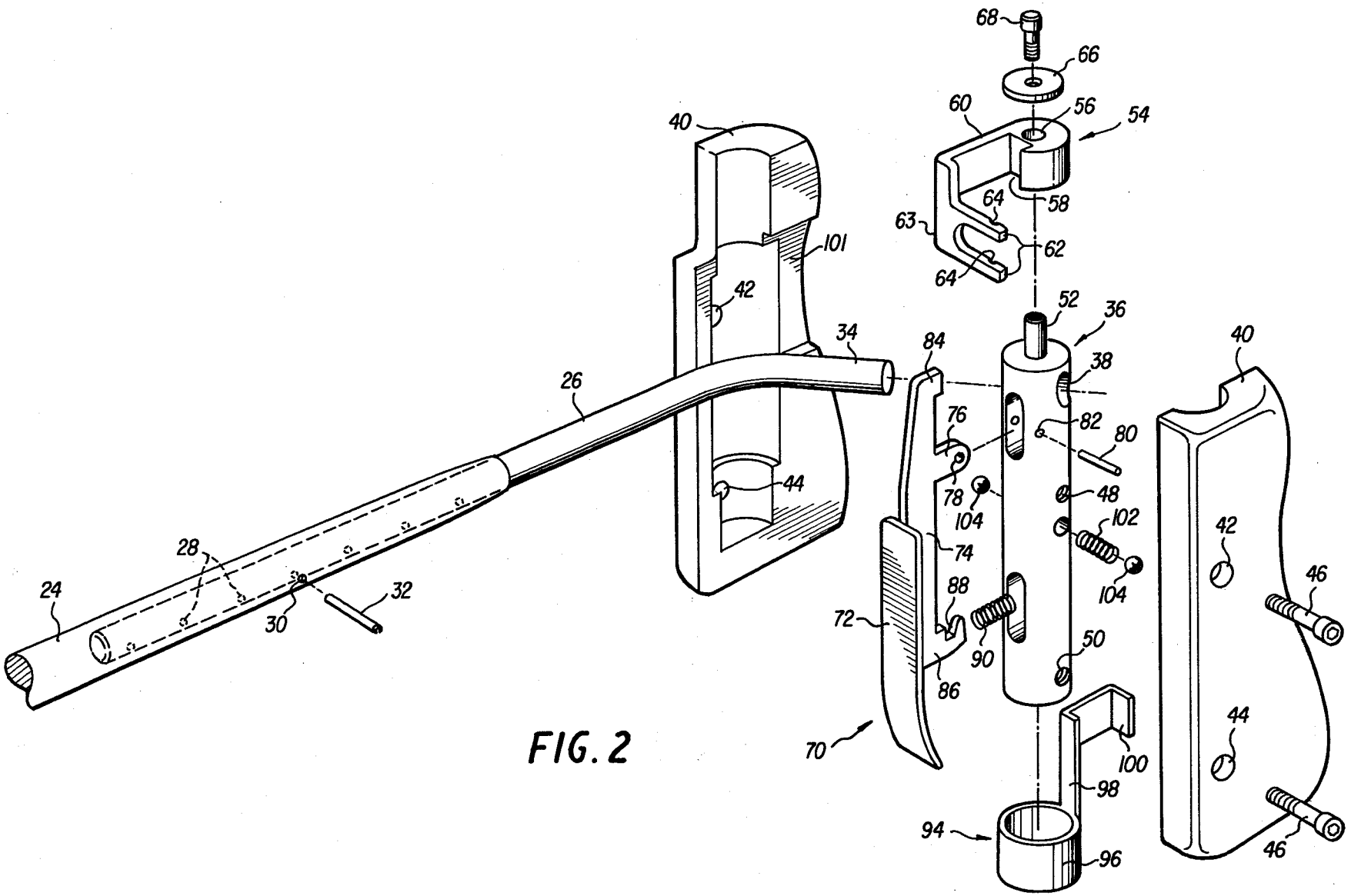
FIG. 2 is an exploded perspective view of a portion of the bow shown in FIG. 1 and drawn to an enlarged scale.

The reverse stabilizer bar means 18 includes a portion 22 attached to the bow by a bolt and a center line adjustable arrow rest and may include a steel buffer adjusting plate (not shown) between the two. Also included is a reverse stabilizer bar 24, preferably made of aluminum of solid cross section and an extension member 26 which is telescopically received within the rearward end of the reverse stabilizer bar 24 with the extension member constituting an adjusting rod. To this end, the adjusting rod as shown in FIG. 2 includes a series of drilled holes 28 and a steel roll pin 32 locks the adjustable extension member in a desired position within the reverse stabilizer bar 24.

In order to effect mounting of the combined trigger and safety release mechanism, the extension member 26 is provided with an offset portion 34 which extends at a 45° angle to a continuation of the direction of stabilizer bar 24 and lies in a horizontal plane. Offset portion 34 is received within a cylindrical actuator spool indicated generally at 36 at the location of bored hole 38. The trigger mechanism is provided with a pair of handle members 40 for the convenience of the archer which encapsulate the actuator spool 36 in its assembled position.

In order to effect assembly of the pair of handle members 40 to the cylindrical actuator 36, drilled holes 42, 44 are provided in each of the handle members and mounting screws 46 extend therethrough into threaded receptor holes 48, 50 in actuator spool 36.

The cylindrical actuator spool 36 is provided with a shaft-like extension 52 on its upper end for the reception thereon of a rotatable arrow release member, indicated generally at 54. The rotatable arrow release member 54 includes a central bore 56, an axially extending peripheral slot 58, a forwardly extending arm 60 and a pair of bifurcated bow string retention members 62. The bifurcated bow string retention members 62 extend at substantially right angles to the forwardly extending arm 60 and are provided with a rear abutment surface 63 to limit the rotational movement of the rotatable arrow release member 54 after an arrow is shot as will be described hereinafter. Each of the bifurcations of the bow string retention member 62 is provided with a notched portion 64 to receive the bow string in the loaded position. A washer 66 preferably made of brass to provide suitable wear characteristics fits atop the rotatable arrow release member 54 and the assembly is held in place with a retaining screw 68.

FIG. 2 also illustrates a trigger mechanism, indicated generally at 70. This trigger mechanism includes a trigger 72, and a pivotal lever 74 which is provided with a rearwardly extending mounting ear 76 that fits into an upper cavity 77 of the cylindrical actuator spool 36. Mounting ear 76 is provided with a drilled hole 78 to receive a steel mounting pin 80 which is inserted through a pin receiving aperture 82 in the actuator spool 36.

Figure 3:
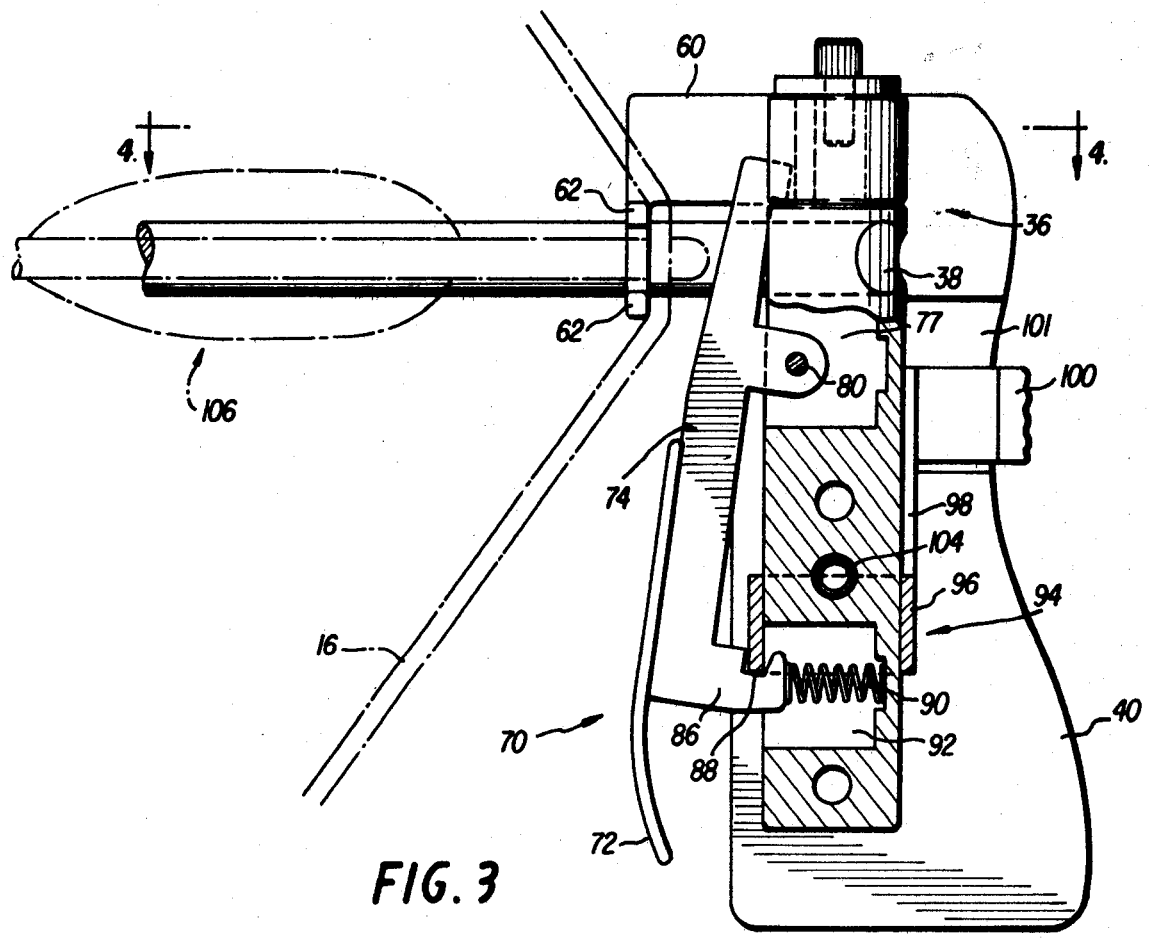
FIG. 3 is a side elevational view taken in vertical cross section of an assembled trigger and safety release mechanism of FIG. 2.
Figure 4:
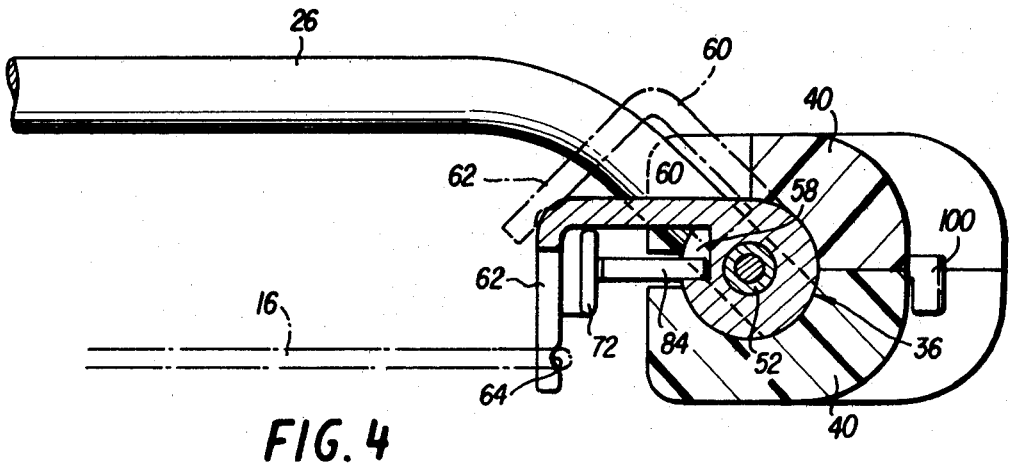
FIG. 4 is a top plan view taken in horizontal cross section along line 4—4 of FIG. 3.
Figure 5:
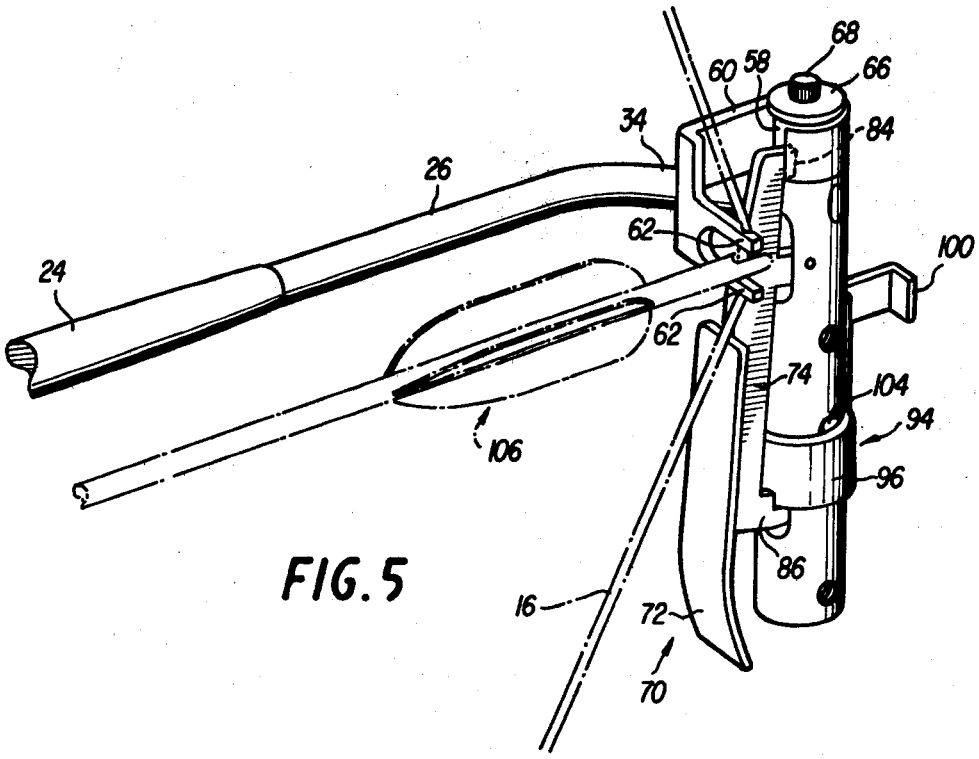
FIG. 5 is a fragmentary perspective view showing an arrow in cocked position with the handle removed.

At the upper end of the pivotal lever 74 there is provided a latch member 84 which, in the safety position illustrated in FIGS. 3, 4, and 5, is contained within the axially extending slot 58 of the rotatable arrow release member 54 to prevent rotational movement thereof. The pivotal lever 74 of the trigger mechanism 70 also includes a trigger thrust member 86 which includes a second latching means in the form of a slot 88 to receive a safety release mechanism in a manner to be described hereinafter. A spring member 90 engages the rearward extension of the trigger thrust member 86 and is received in a lower cavity 92 of the cylindrical actuator spool 36 as is most clearly illustrated in FIG. 3.

Figure 6:
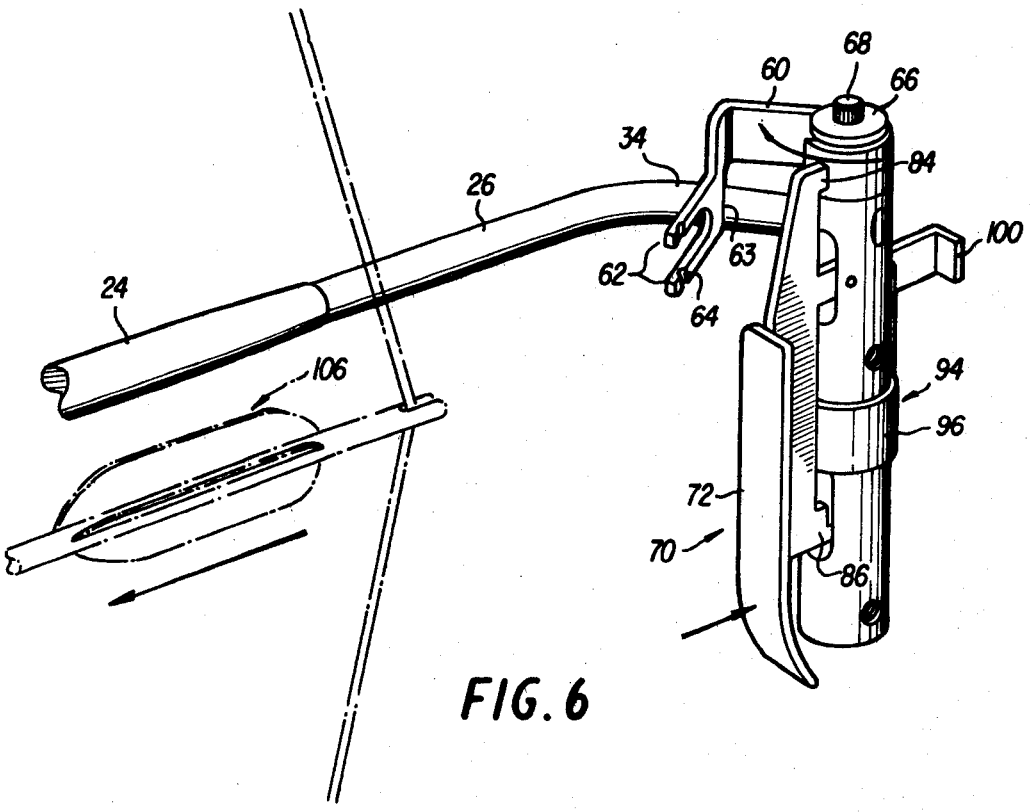
FIG. 6 is a fragmentary perspective view similar to FIG. 5 but showing the arrow and trigger mechanism shortly after the arrow is released.

A safety release mechanism is indicated generally at 94 and includes a hollow cylindrical bottom portion 96, an upwardly extending arm 98 and a thumb actuator 100 extending rearwardly thereof. The safety release mechanism in its assembled position, illustrated in FIGS. 3, 5 and 6, is axially movable on the cylindrical actuator spool 36 in order to place the safety release mechanism into its operative and inoperative positions. In the positions shown in FIGS. 3 and 5, the lower surface of the hollow cylindrical bottom portion 96 of the safety release mechanism 94 is inserted within slot 88 of the trigger thrust member 86 so as to prevent compression of trigger 72 thereby preventing rearward motion of the trigger mechanism 70. In the position shown in FIG. 6 the safety release mechanism has been moved upwardly on the cylindrical actuator spool 36 thereby permitting the trigger mechanism to be squeezed and thereby shooting an arrow as will be explained hereinafter.

As is seen in FIGS. 2 and 3, the handle members 40 include a slot 101 through which the thumb actuator 100 extends with the upper extent of the slot limiting the extent that the safety release mechanism 94 may be moved upwardly along the cylindrical actuator spool 36.

In order to prevent the safety release mechanism from being subjected to a free fall condition after it has been raised on the actuator spool 36, there is provided a spring 102 which, as is seen in FIG. 2, is positioned within a drilled hole in the cylindrical actuator spool 36. A pair of steel balls 104 are assembled on the outer end of the spring 102 with each steel ball 104 bearing against the inside surface of the hollow cylindrical bottom portion 96 of the safety release mechanism 94 providing sufficient tension thereon to prevent the free falling of the safety release mechanism 94 when it is in its raised position.

FIGS. 3 and 5 illustrate an arrow, indicated generally at 106, in its loaded position and FIG. 6 illustrates the arrow 106 in bow string 16 immediately after being fired.

The operation of the compound archery bow and its attachments will now be explained. After the complete assembly of all parts and the installation of the stabilizer bar on the bow, properly aligned vertically and horizontally, the bow is in position to be cocked and loaded for shooting. This procedure includes rotating the rotatable arrow release member 54 counterclockwise until it is locked into a 90° position with respect to the reverse stabilizer bar 24, that is, the bifurcated bow string retention member 62 is at right angles to the stabilizer bar 24. Using the thumb actuator 100, the safety release mechanism 94 is slid down on the cylindrical actuator spool 36 until the bottom surface of the hollow cylindrical bottom portion 96 rests within the slot 88 of the trigger thrust member 86 in the position illustrated in FIGS. 3 and 5.

With the unit in its completely safety locked position, place the left foot on the bow handle and with both hands pull the bow string 16 rearwardly into the notched portion 64 of the bifurcated bow string retention member 62. Insert the arrow by sliding it between the bifurcated bow string retention member 62 and snapping it onto the bow string 16 in its rearward position, as shown in FIG. 5 with the front of the arrow resting on the adjustable arrow rest at 22. When firing of the arrow is desired, the bow is held in a cited position, but these sight members are conventional and are not illustrated in the drawings. The safety release mechanism 94 is pushed upwardly unlocking the trigger mechanism 70. Trigger 72 is pulled or squeezed in a rearward direction compressing spring 90. This simultaneously pivots the upper latch member 84 out of axially extending slot 58. This permits the rotatable arrow release member 54 to rotate in a clockwise direction until the rear abutment surface 63 contacts the 45° offset end portion 34, as is illustrated in FIG. 6 and the phantom position in FIG. 4, and allows the bow string 16 and arrow 106 to move forward in a smooth flight position as is also illustrated in FIG. 6.

The illustrated attachments to a compound bow will permit operation from 25 lbs. to 115 lbs. draw weight, thereby making it available to all weight compound bows. The adjustment provided by the extension member 26 permits adjustment from 25 inches to 31 inches draw giving an archer an exact draw length. The tapered aluminum rod constituting the reverse stabilizer bar 24 absorbs the full recoil shock of a very high compression magnum bow. With the use of this bar, a bow can be held with two fingers of the left hand and released with amazing accuracy from zero to 60 yards distance, thus making it a highly satisfactory unit for persons with medical problems such as heart trouble, shoulder or back problems. It is also very suitable for use by women to hunt big game animals as has been noted.

While a presently preferred embodiment of the invention has been illustrated and described, it will be recognized that the invention may be otherwise variously embodied and practiced within the scope of the claims which follow.

I claim:

1. A combined trigger and safety release mechanism for an archery bow for shooting arrows which comprises a. a handle member, b. a cylindrical actuator spool received within said handle member, (1) said cylindrical actuator spool having a shaft-like extension on its upper end, c. a rotatable arrow release member mounted on said shaft-like extension, d. a trigger mechanism pivotally mounted on said cylindrical actuator spool, (1) said trigger mechanism having a pivotal lever with first latch means engageable with said rotatable release mechanism and second latch means for locking said trigger mechanism in place, e. and a safety release mechanism engageable with said second latch means to lock said trigger mechanism.

2. A combined trigger and safety release mechanism as defined in claim 1 wherein said safety release mechanism includes a hub member axially slidable on said cylindrical actuator spool.

3. A combined trigger and safety release mechanism as defined in claim 2 wherein said cylindrical actuator spool contains means to prevent the free fall of said safety release mechanism.

4. A combined trigger and safety release mechanism as defined in claim 3 wherein said means to prevent the free fall of said safety release mechanism includes spring-loaded ball means engageable with the inside surface of said hub member.

5. A combined trigger and safety release mechanism as defined in claim 2 wherein said second latch means includes slot means to receive the bottom edge of said hub member.

6. A combined trigger and safety release mechanism as defined in claim 5 wherein said cylindrical actuator spool is provided with a cavity to receive spring means for spring loading said trigger mechanism.

7. A combined trigger and safety release mechanism as defined in claim 6 wherein said cavity in said cylindrical actuator spool is so positioned to permit entry therein of said second latch means when said safety mechanism is released and said trigger mechanism is squeezed.

8. A combined trigger and safety release mechanism as defined in claim 1 wherein said rotatable arrow release member includes a slot to receive said first latch means of the pivotal lever of said trigger mechanism.

9. A combined trigger and safety release mechanism as defined in claim 1 wherein said cylindrical actuator spool is provided with a cavity to receive spring means for spring loading said trigger mechanism.

* * * * *